US006716062B1

(12) United States Patent
Palinkas et al.

(10) Patent No.: US 6,716,062 B1
(45) Date of Patent: Apr. 6, 2004

(54) COAXIAL CABLE F CONNECTOR WITH IMPROVED RFI SEALING

(75) Inventors: Raymond Palinkas, Canastota, NY (US); Michael T. Fox, Syracuse, NY (US); Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/277,756

(22) Filed: Oct. 21, 2002

(51) Int. Cl.[7] ..... H01R 9/05

(52) U.S. Cl. ..... 439/578; 439/320; 439/700

(58) Field of Search ..... 439/578, 320, 439/583–585, 322, 323, 700, 824, 607, 610

(56) References Cited

U.S. PATENT DOCUMENTS

| | | | | |
|---|---|---|---|---|
| 3,587,033 A | | 6/1971 | Brorein | |
| 3,680,034 A | | 7/1972 | Chow et al. | |
| 3,781,762 A | * | 12/1973 | Quackenbush | 439/322 |
| 3,970,355 A | * | 7/1976 | Pitschi | 439/578 |
| 4,174,875 A | | 11/1979 | Wilson et al. | |
| 4,285,564 A | | 8/1981 | Spinner | |
| 4,836,801 A | | 6/1989 | Ramirez | |
| 4,915,651 A | | 4/1990 | Bout | |
| 4,941,846 A | * | 7/1990 | Guimond et al. | 439/578 |
| 5,011,432 A | | 4/1991 | Sucht et al. | |
| 5,217,393 A | | 6/1993 | Del Negro et al. | |
| 5,439,386 A | | 8/1995 | Ellis et al. | |
| 5,490,801 A | | 2/1996 | Fisher, Jr. et al. | |
| 5,501,616 A | | 3/1996 | Holliday | |
| 5,516,303 A | | 5/1996 | Yohn et al. | |
| 5,571,028 A | | 11/1996 | Szegda | |
| 5,632,637 A | | 5/1997 | Diener | |
| 5,722,856 A | | 3/1998 | Fuchs et al. | |
| 5,746,617 A | | 5/1998 | Porter, Jr. et al. | |
| 5,746,619 A | | 5/1998 | Harting et al. | |
| 5,769,652 A | | 6/1998 | Wider | |
| 5,879,191 A | | 3/1999 | Burris | |
| 5,921,793 A | | 7/1999 | Phillips | |
| 5,944,548 A | | 8/1999 | Saito | |
| 6,053,777 A | * | 4/2000 | Boyle | 439/700 |

* cited by examiner

*Primary Examiner*—Renee Luebke
*Assistant Examiner*—Felix O. Figueroa
(74) *Attorney, Agent, or Firm*—Christopher R. Pastel; Hancock & Estabrook, LLP

(57) ABSTRACT

An F-type connector for mounting to a prepared terminal end of a coaxial cable for threaded engagement of a nut on the connector to a threaded shaft at a port on video equipment to which the coaxial cable is to be electrically connected. In the connector of the present invention, the nut is mounted for limited axial movement with respect to the post, body and compression ring. A coil spring biases the nut toward a rest position with respect to the other elements wherein not more than three revolutions of the nut into engagement with the shaft are necessary in order to bring the post of the connector into contact with the shaft on the equipment, providing a satisfactory coupling. Upon further revolution of the nut, the post and shaft remain in contact as the nut moves axially away from the rest position with respect to the other elements.

33 Claims, 8 Drawing Sheets

COAXIAL CABLE F CONNECTOR WITH IMPROVED RFI SEALING

BACKGROUND OF THE INVENTION

The present invention relates to F-type connectors used in CATV applications, and more specifically to structure providing improved engagement of the RFI seal of such connectors against the connector face.

The frequencies of RF signals transmitted through coaxial cables to a subscriber TV set are typically in the range of 5 to 40 MHz. This frequency range is plagued with noise ingress that degrades system performance. Studies have shown that the majority of ingress is related to poorly installed F connectors. These connectors are normally mounted upon the end of a coaxial cable for connection to a port on the television set. Connection is usually made by the subscriber in the home via an internally threaded nut of the connector and an externally threaded stub shaft surrounding the port. For fully threaded connection, ensuring the necessary abutment of the RFI seal of the cable against the equipment connector face, the nut must be rotated up to 5 or 6 full revolutions. The typical, non-technical subscriber making the installation often fails to fully tighten the connector for one or both of two reasons: first, the visual performance functions may be obtained with a partial connection and, once the subscriber sees the video operating on the TV screen, it is assumed that the connection is satisfactory, and, secondly, the location of the equipment is often such that the subscriber must reach around and behind the equipment and thus cannot sec the port as the connector is being installed.

It is a principal object of the present invention to provide an F-type connector for threaded engagement with a port on a TV set or other equipment receiving RF signals through a coaxial cable to which the connector is mounted wherein a secure RFI seal is obtained in a simplified manner.

Another object is to provide an F-type connector having novel and improved features ensuring shielded connection to an input port and which is compatible with an end portion of a coaxial cable which has been prepared in an industry standard manner.

A further object is to provide an F-type connector with enhanced ease of proper installation which is compatible with either compression or crimp attachment of the connector to the coaxial cable.

Other objects will in part be obvious and will in part appear hereinafter.

SUMMARY OF THE INVENTION

The connector of the invention is disclosed in two embodiments each having a total of five elements, namely, a body, a nut, a post, a compression ring and a coil spring. The body, nut, post and compression ring are basically the same in structure and function as corresponding elements in conventional F connectors, and are mounted in similar manner upon the end of the coaxial cable. That is, the nut is connected to the flanged end of the post and is freely rotatable, although axially moveable, with respect thereto. The end of the cable is prepared for mounting to the connector by stripping away all covering layers from the central, rigid conductor for a first length, and stripping the braided, shielding layer and outer layer of dielectric material for a second length. The non-flanged end of the post is then forced between the aluminum conducting layer which surrounds the inner layer of dielectric material and the braided layer until the end of the inner dielectric layer and surrounding conducting layer are substantially coplanar with the surrounding, annular surface of the post. The relative axial positions of the nut and post are such that, in the typical case, six or seven full revolutions of the nut are required to bring the annular post surface into contact with the end of the stub shaft surrounding the port on the equipment to which the connector is attached; anything less than full contact of the connector post with the stub shaft, as previously mentioned, provides incomplete shielding and permits noise ingress.

In the connector of the present invention, the additional element, i.e., the coil spring, has opposite ends bearing against the underside of the post flange and a portion of the nut. The nut is axially movable to a limited degree with respect to the post (and other elements of the connector) between a first, or rest position, in which it is held by the spring prior to threading the nut onto the shaft, and a second position, wherein the nut is axially displaced by a maximum distance from the rest position. In the rest position, the threaded portion of the nut extends a short way, e.g., one or two thread revolutions, beyond the end of the inner dielectric layer and aluminum conducting layer of the coax cable and the surrounding, annular surface of the post. Thus, when the end of the nut is brought into contact with the end of the shaft, only one or two revolutions of the nut are required to establish contact of the post surface and shaft, thereby providing an acceptable degree of shielding to prevent ingress of noise and degradation of signal at the connector-equipment interface. However, the connector of the invention permits further threaded engagement of the nut and shaft by compression of the spring upon continued rotation of the nut as the latter moves axially with respect to the post.

In the first disclosed embodiment, the elements are assembled by inserting the non-flanged end of the post into the connector body until the latter abuts the underside of the flange, then placing the spring in surrounding relation to the body with one end contacting the underside of the flange, outwardly of the body. The nut is then placed over the post flange and spring with the inner end of the threaded portion of the nut contacting the post flange on the surface opposite a first end of the spring and the other, open end of the nut extending past the other end of the spring. This open end of the nut is then deformed, i.e., peened over, to a diameter less than that of the spring, whereby the ends of the spring are captured between the underside of the post flange and the deformed end of the nut. Axial movement of the nut relative to the post in a direction moving the threaded end of the nut away from the post, as when the nut is threaded onto the shaft of the equipment input port, thus compresses the spring. Conversely, when the threaded connection is removed, the spring moves the nut back to its aforementioned rest position with respect to the post.

In the second disclosed embodiment, the spring is captured between the underside of the post flange and an integrally formed flange on the inside of the nut, spaced from the threaded portion thereof. In this case, the spring surrounds the post (rather than the body), the elements being assembled by placing the spring within the nut, one end of the spring contacting the ingral flange within the nut, then inserting the post through the nut and mounting the body upon the post below the nut. This embodiment has the advantage that no deforming or peening operation is required in assembly of the elements; however, a non-standard preparation of the end of the coax cable is required due to the spacing of the end of the body from the underside of the post flange.

The foregoing and other features of construction and operation of the invention will be more readily understood and fully appreciated from the following detailed disclosure, taken in conjunction with accompanying drawings.

DETAILED DESCRIPTION

Figure 1:
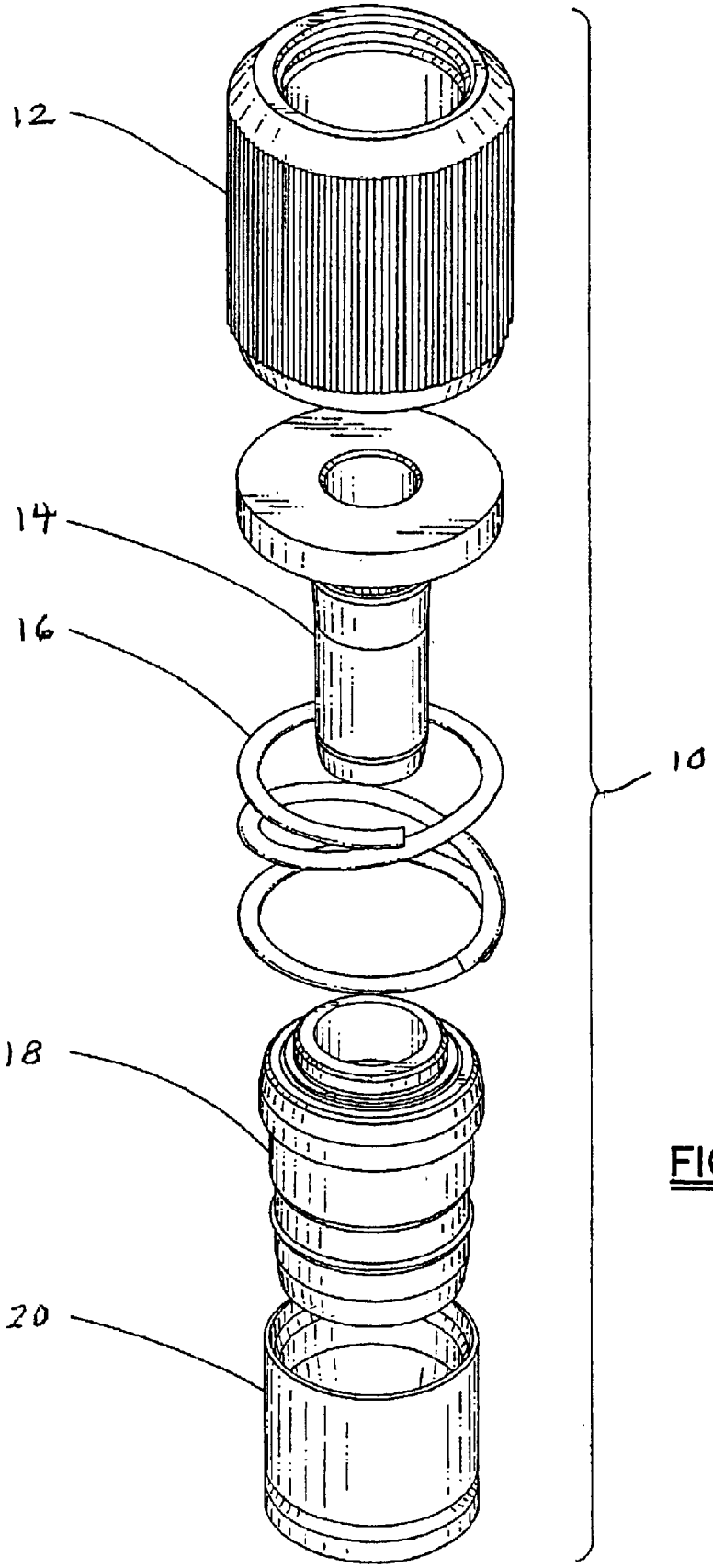
FIG. 1 is an exploded perspective view of a first embodiment of the elements of the connector of the invention.
Figure 2:
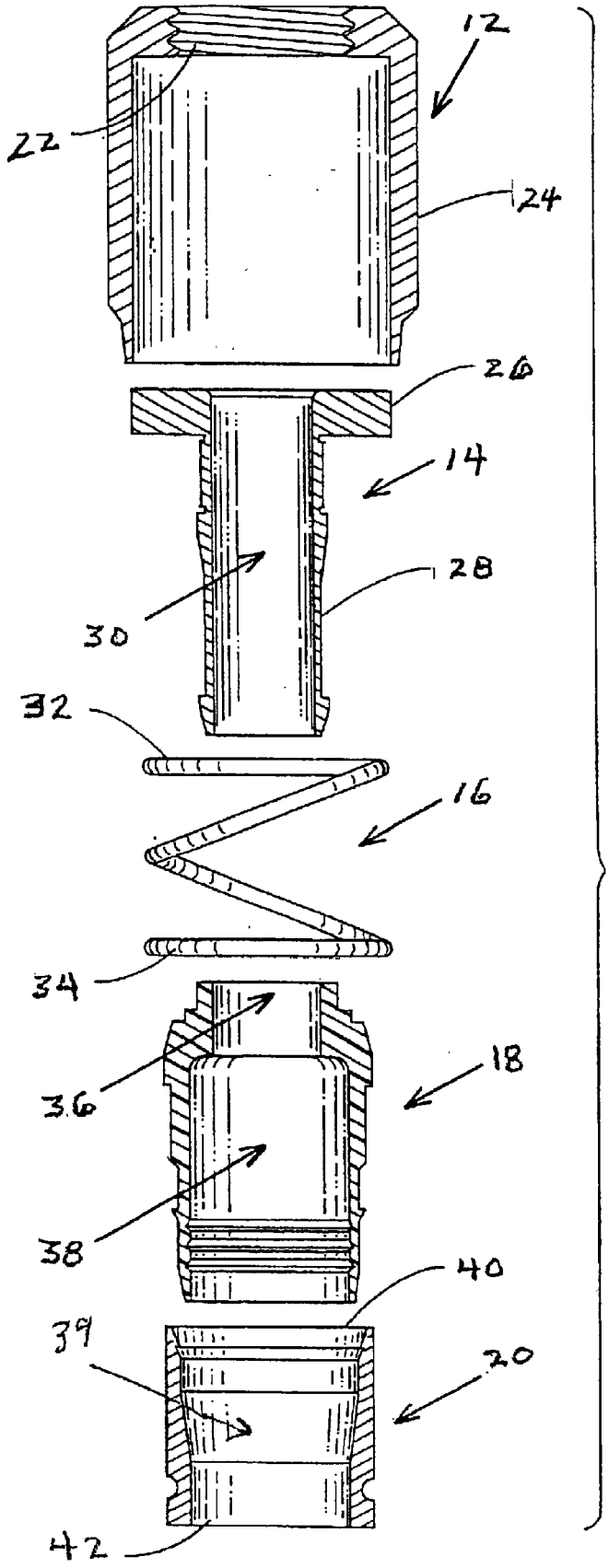
FIG. 2 is an exploded, side elevational view, in section, of the elements of FIG. 1.

Elements of the preferred embodiment of the invention are shown in FIGS. 1 and 2, the connector of this embodiment being denoted generally by reference numeral 10. Connector 10 is made up of a total of five elements, namely, nut 12, post 14, coil spring 16, body 18 and compression ring 20. Nut 12 includes internally threaded bore 22 at one end and cylindrical skirt 24 which in its initial form is of constant diameter, larger than that of bore 22, throughout its axial length. Flange 26 at one end of post 14 is integrally attached to stem portion 28, the flange and stem cooperatively defining constant diameter bore 30, extending fully through post 14. Spring 16 has upper and lower surfaces 32 and 34, respectively, in parallel planes spaced by a predetermined distance, i.e., spring 16 has a predetermined axial length in its undeformed condition. Body 18, which includes bores 36 and 38 of different diameters, is made of a suitable elastomeric material which is deformable under sufficient applied pressure. Compression ring 20 has an internal bore 39 generally tapering from a larger diameter at one end 40 to a smaller diameter at end 42.

It will be immediately recognized by those skilled in the art that the elements of the connector of the present invention generally duplicate those of prior art F connectors, with the addition of the coil spring. That is, prior art connectors of this type include an internally threaded nut, a flanged post, a deformable body and an internally tapered compression ring. Typically, the post flange is positioned at the inner termination of the nut threads, the body surrounds the stem of the post, and the tapered, internal surface of the compression ring is moved axially on the body to radially compress the latter, thereby tightly engaging the outer layers of the coaxial cable between the body and post. The end of the cable is "prepped" (i.e., portions of the various layers are cut and removed) according to industry standards prior to mounting thereon of the connector. After mounting, the center conductor of the coaxial cable extends forwardly of the connector to enter the opening and the female connector of the port to which the cable is connected. As previously noted, such prior art connectors often require 6 or 7 complete revolutions of the nut in order to achieve fully threaded engagement of the nut (connector) and the port of the equipment to which the cable is electrically connected, and failure to effect such fully threaded engagement degrades the quality of the RFI shield provided by firm engagement of the metal post and the threaded shaft defining the port.

Figures 3, 3A:
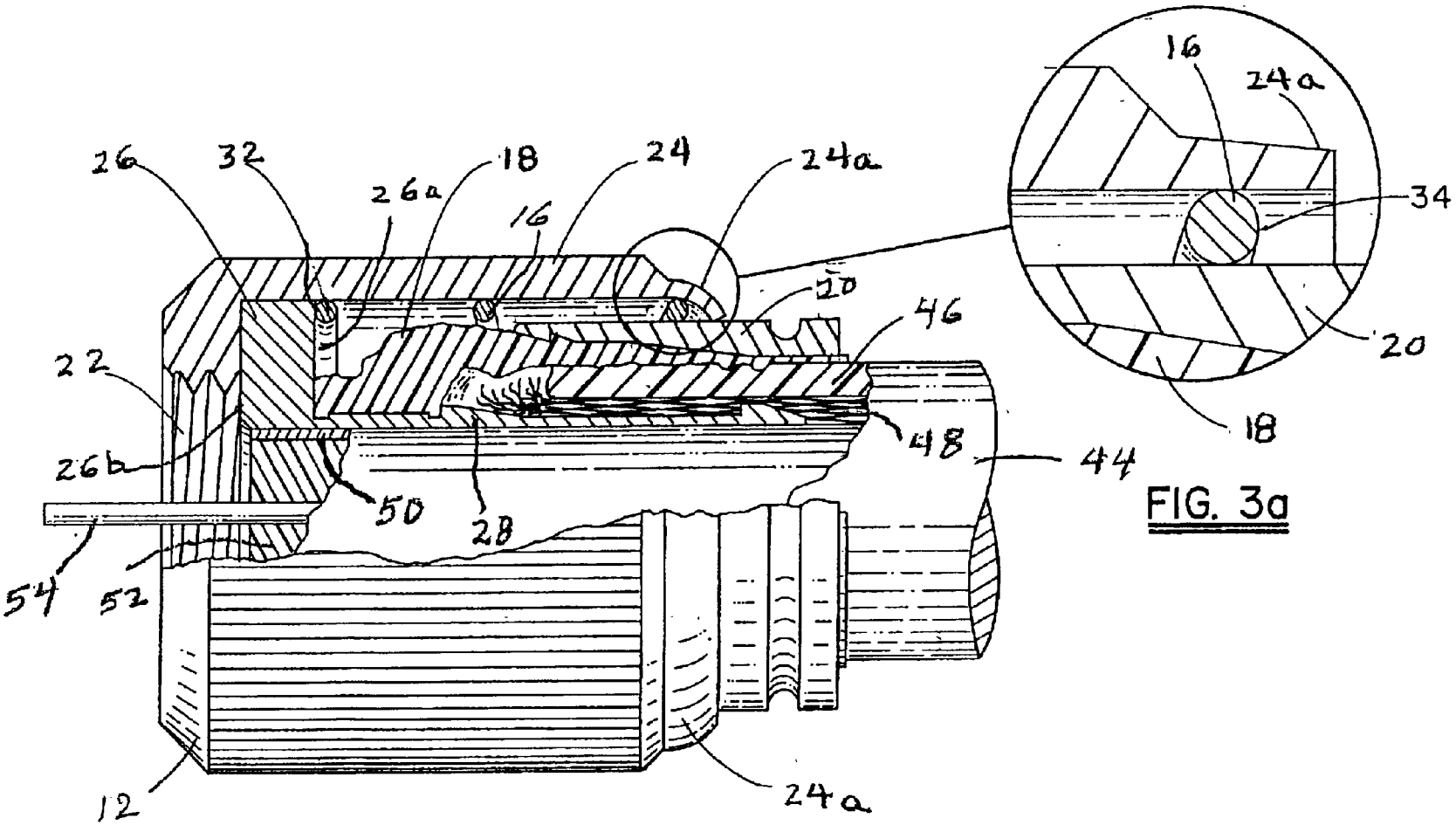
FIG. 3 is a side elevational view, with portions broken away, of the elements of FIGS. 1 and 2 in assembled condition, mounted upon one end of a coaxial cable.
FIG. 3*a* is an enlargement of the circled portion of FIG. 3 showing one of the elements in an initial configuration, prior to a mechanical forming operation.

Elements of connector 10 are assembled with one another and mounted upon the end of a prepped coaxial cable in much the same manner as prior art F connectors with the notable exception of the inclusion of spring 16. In the presently described embodiment, after sliding post 14 into bore 36 of body 18 and placing ring 20 upon the body, spring 16 is placed with surface 32 thereof contacting surface 26*a*, termed the underside, of post range 26 and the spring encircling portions of body 18 and compression ring 20. Skirt 24 of nut 12 initially has a uniform inside diameter substantially equal to or slightly larger than the outside diameter of flange 26. Nut 12 is slid over flange 26 until the inner surface surrounding threaded bore 22 contacts surface 26*b* of flange 26. Skirt 24 includes annular portion 24*a*, having a thickness less than that of the major portion of the skirt and initially having an inside diameter equal to that of the rest of the skirt, as shown in FIG. 3*a*. The previously mentioned predetermined axial length of spring 16 is such that planar surface 34 is located within annular portion 24*a* when the elements are assembled as shown in FIG. 3. After spring 16 is so positioned, annular portion 24*a* is peened over, i.e., deformed, from its initial, straight configuration of FIG. 3*a* to the bent configuration of Figure 3. As described later in more detail, nut 12 may be moved axially relative to the other elements, causing compression of spring 16 between surface 26*a* of flange 26 and annular portion 24*a* of skirt 24.

Connector 10 is shown in FIG. 3, and FIGS. 3*b*–3*d*, mounted upon a terminal end of conventional coaxial cable 44. Prior to mounting of the connector, cable 44 is prepped by cutting through outer layer 46 of dielectric material, braided metal layer 48, aluminum layer 50 and inner dielectric layer 52 at a predetermined distance from the end of the cable and removing the end portions of these layers to leave a predetermined length of the central conductor 54 bare. Layers 46 and 48 are then cut through at another predetermined position and the severed slug is removed. The cable is then inserted into the connector with layers 50 and 52 essentially filling bore 30 of post 14; and the end surfaces of these layers substantially coplanar with surface 26*b* of flange 26. The end of post 14 opposite flange 26 is forced between braided layer 48 and aluminum layer 50, leaving the end portions of layers 46 and 48 positioned in the space between the outside surface of post stem 28 and bore 38 body 18. Compression ring 20 is then moved, by a conventional compression tool (not shown), axially upon body 18 toward the left as viewed in FIG. 3. This radially compresses body 18 and grips layers 46 and 48 tightly between the post and body, thereby mounting connector 10 upon cable 44 in an essentially permanent manner. It is again emphasized that the cable is prepped in an industry standard manner and the connector is mounted to the cable in conventional fashion.

Figure 3D:
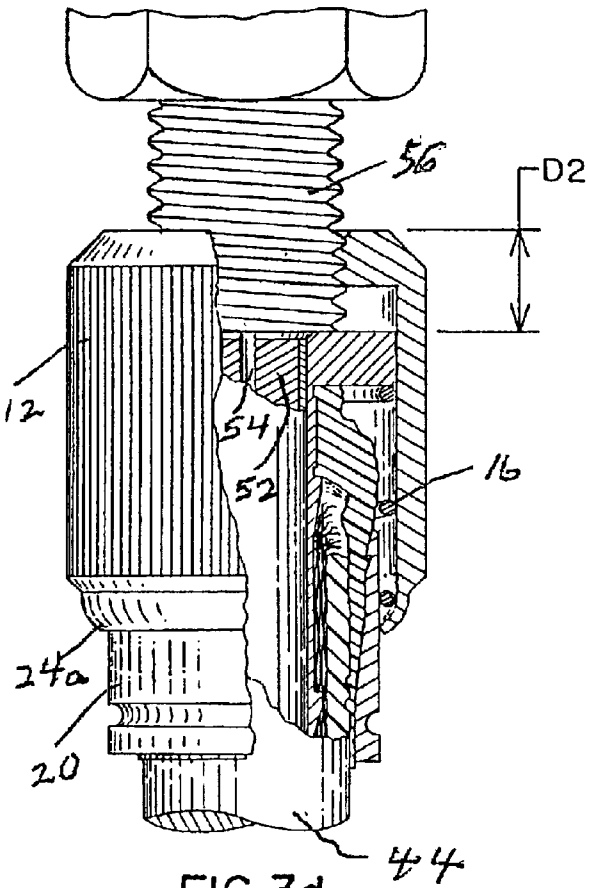
FIGS. 3*b*–3*d* are side elevational views, with portions broken away, of the assembled elements of the connector with associated coaxial cable end and equipment port, showing three sequential, relative positions of the elements as the connector is threadedly engaged with a shaft on the TV receiver or other such equipment.
Figure 3C:
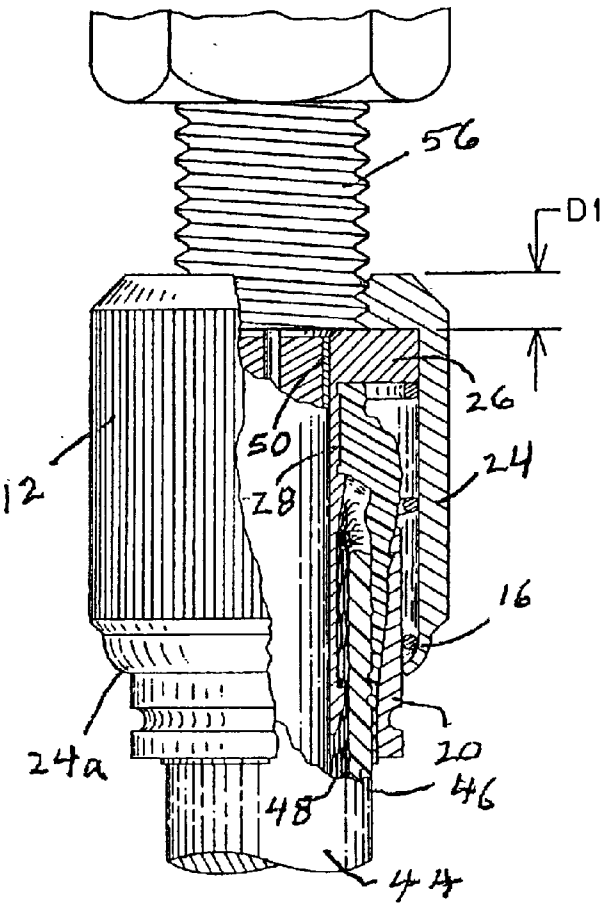
Figure 3B:
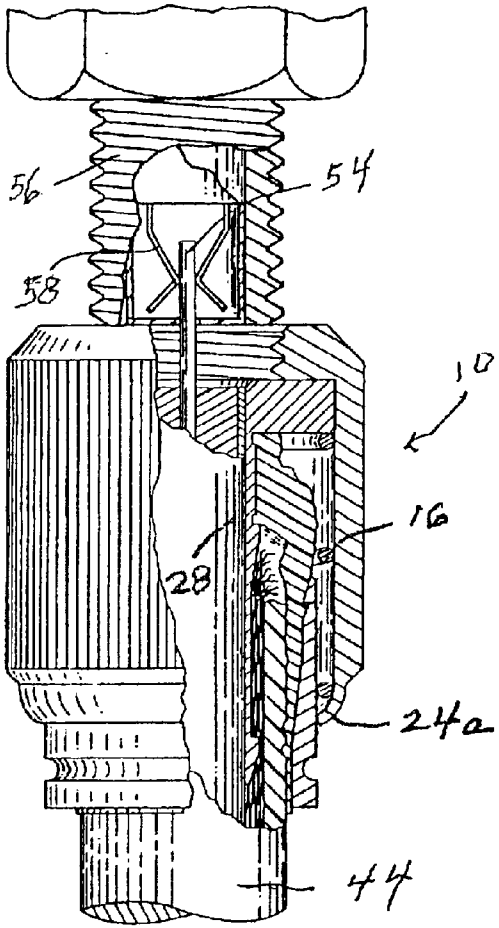
Figure 4:
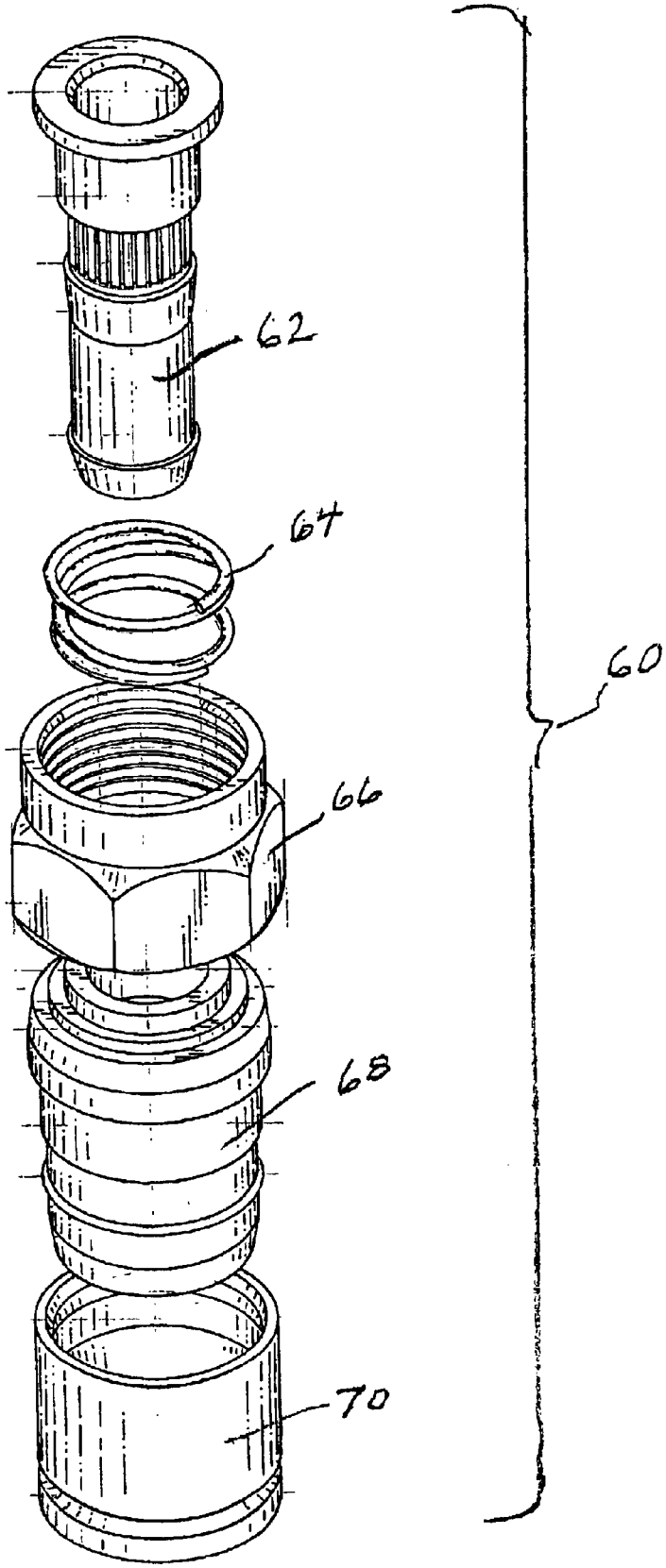
FIG. 4 is an exploded perspective view of a second embodiment of the connector.
Figure 5:
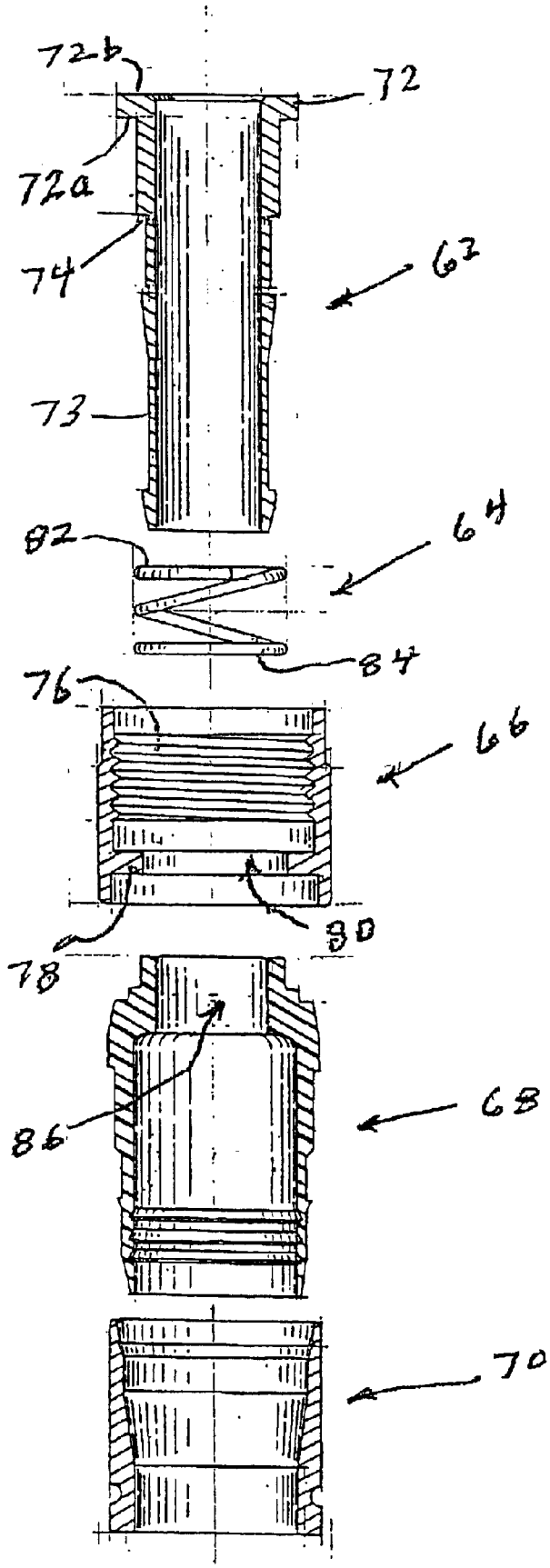
FIG. 5 is an exploded, side elevational view, in section, of the elements of FIG. 4.

Turning now to FIGS. 3*b*–3*d*, connector 10 is shown in association with an externally threaded stub shaft 56 at a port of a TV receiver or other such equipment. Shaft 56 is hollow and contains female contacts 58 for receiving the end of center conductor 54 of cable 44. In the position shown in FIG. 3*b* connector 10 has been moved to position threaded bore 22 in alignment with the end of shaft 56, preparatory to threaded engagement of the connector upon the shaft. In FIG. 3*c*, nut 12 has been rotated, e.g., a couple of revolutions, thereby moving connector 10 axially upon shaft 56 by the distance indicted as D1 and bringing the end of shaft 56 into contact with surface 26*b* of flange 26. The metal-to-metal contact of shaft 56 and flange 26 provides acceptable RFI shielding and substantially eliminates noise ingress and signal degradation for the user who rotates the connector nut only until it is threadedly engaged with the shaft. However, a more secure connection may be obtained, in the sense that the nut is engaged over a longer axial portion of the shaft, by continued rotation of nut 12 to the position of FIG. 3*d*. The nut has moved upon the shaft by the distance indicated as D2, although other elements of connector 10 have not moved relative to the shaft. The axial distance by which the nut has moved between FIGS. 3*c* and 3*d*, i.e., the difference between distances D1 and D2, is the distance by which spring 16 has been compressed. As the nut travels axially on the shaft, annular portion 24*a* of skirt 24 bears against end 34 of the spring and compresses the spring as end 32 is held stationary against surface 26*a* of flange 26. It is apparent that as nut 12 is rotated to remove it from shaft 56 the elements will move in reverse order as spring 16 returns to its rest position, moving nut 12 back into contact with surface 26*b* of flange 26.

Figure 6:
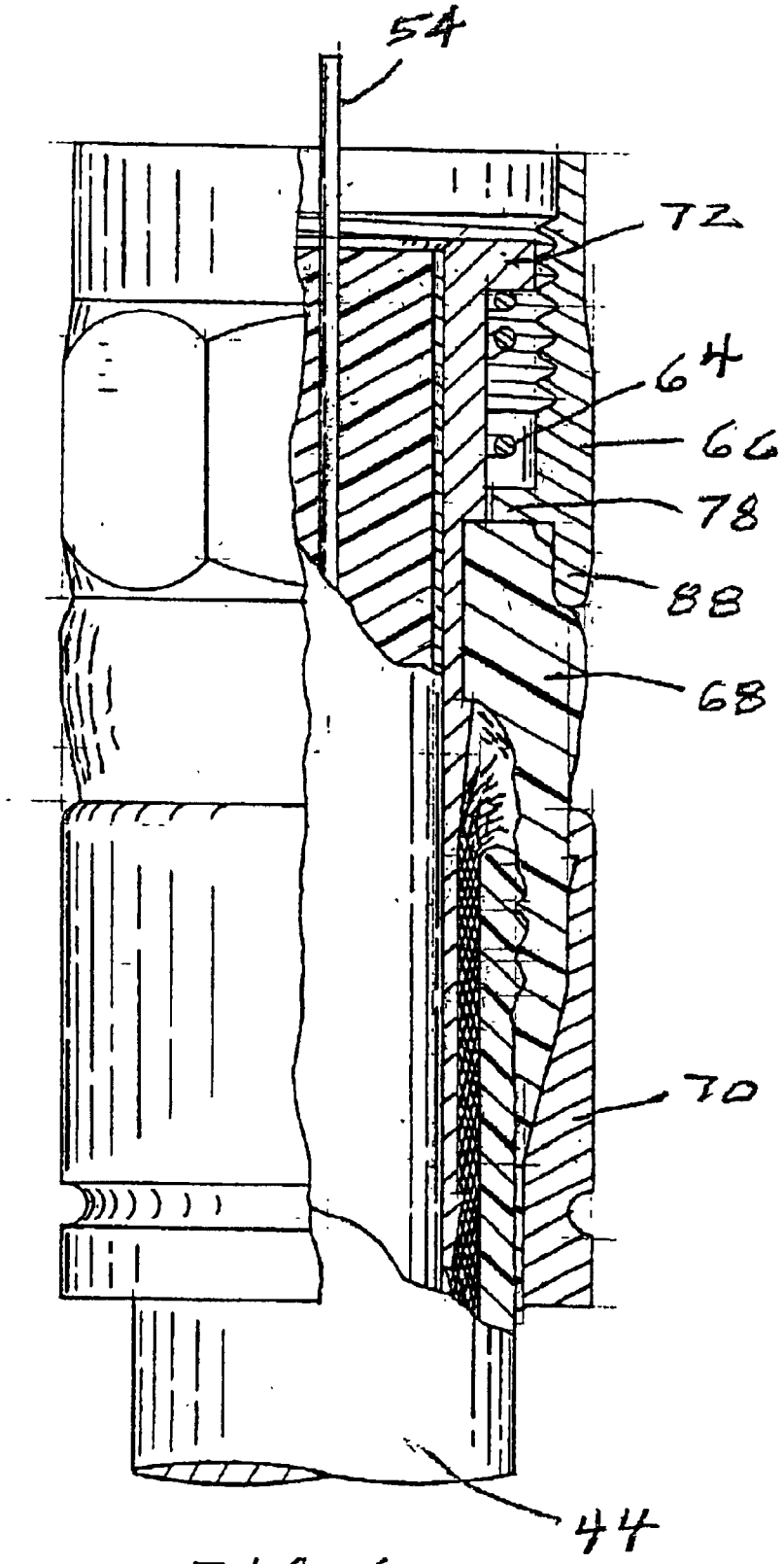
FIG. 6 is a side elevational view, with portions broken away, of the elements of FIGS. 4 and 5 in assembled condition, mounted upon one end of a coaxial cable with certain elements in a first position of relative movement.

The connector is shown in a second embodiment, denoted generally by reference numeral 60, in FIGS. 4–7 Connector 60 is formed from the same five elements as connector 10, 20 namely post 62, coil spring 64, nut 66, body 68 and compression ring 70. However, the configurations of post 62 and nut 66 are somewhat different than post 14 and nut 12 of the previous embodiment and the manner of assembly of the two connectors is not the same. In addition to flange 72 and stem 73, post 62 includes external shoulder 74, spaced a predetermined distance from surface 72*a* of the flange. Nut 66 includes internally threaded bore 76 and integrally formed, internal flange 78 defining opening 80. In assembly of the elements, stem 73 of post 62 is passed through spring 64 and nut 66 with the upper surface 82 of the spring bearing against surface 72*a* of post flange 72 and the lower spring surface 84 bearing against surface 78*a* of nut flange 78. Stem 73 is passed through bore 86 of body 68 until the end of the body contacts shoulder 74. In this position, as seen in FIG. 6, flange 78 and end portion 88 of nut 66 bears against an abutment surfaces of body 68. Compression ring 70 is placed over body 68 as in the previous embodiment.

Figure 7:
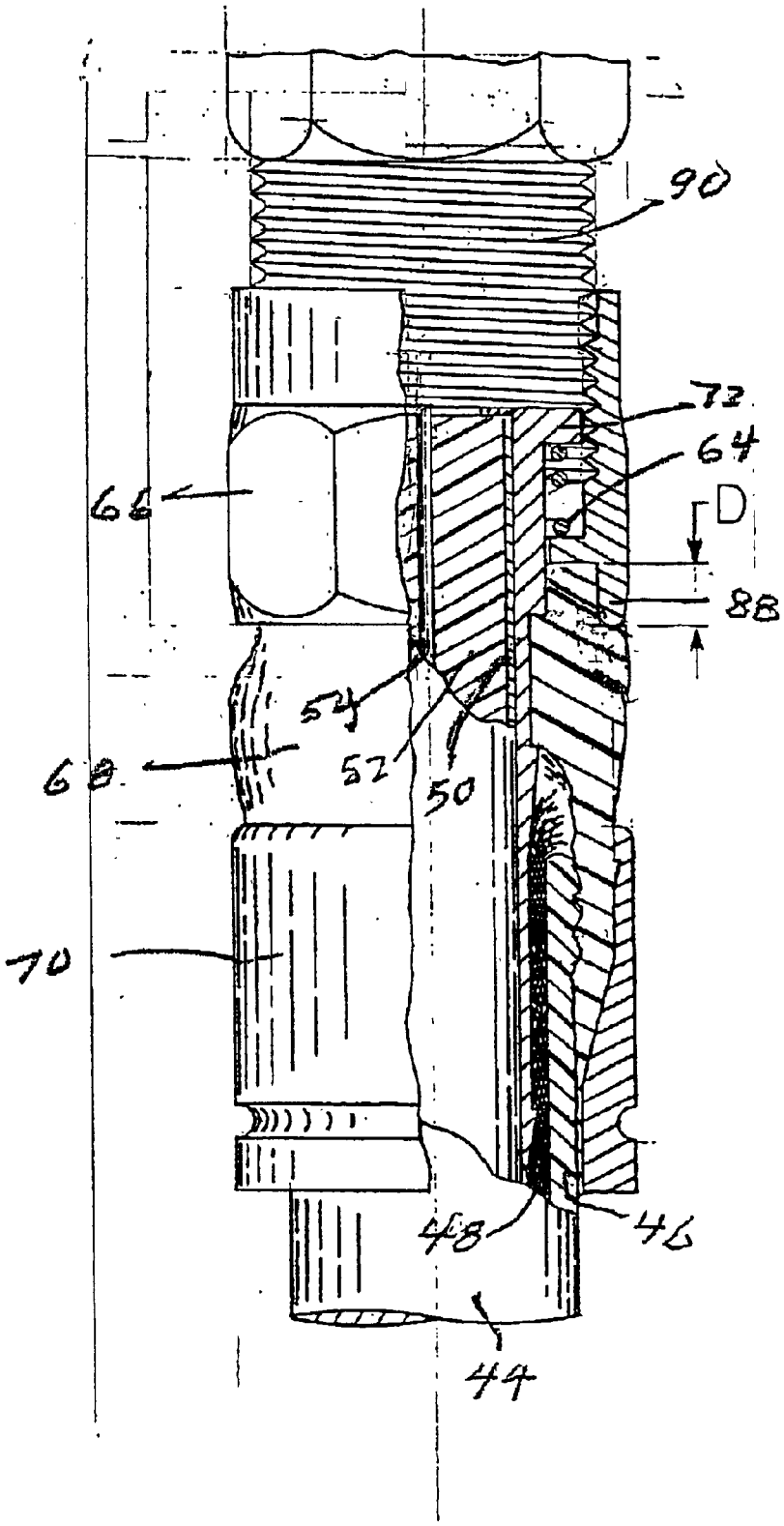
FIG. 7 is the same view as FIG. 6 with the elements in a second position of relative movement.

The same reference numerals are used in FIGS. 6 and 7 for the coaxial cable and its various layers as in FIGS. 3 and 3*b*–3*d*. Cable 44 is again prepped by removing all layers to provide a predetermined length of bare center conductor 54. However, the axial length of outer dielectric layer 46 and braided layer 48 which are removed is longer than in the "standard" prepped cable of the first embodiment. This is because body 68 bears against shoulder 74 rather than the underside of the post flange in order to place spring 64 in surrounding relation to the post, i.e., in the space between the post and nut, rather than to the body and compression ring. Thus, the present embodiment avoids the assembly operation of deforming or peening over the end of the nut, but has the disadvantage of requiring a non-standard prep of the cable.

Connector 60 is shown in FIG. 7 in threaded engagement with shaft 90. Nut 66 has been rotated a number of times to travel axially on the shaft while compressing spring 64 between nut flange 78 and post flange 72. Nut 66 has moved an axial distance D with respect to the other elements of connector 60, and will move the same distance in the opposite direction, under the biasing force of spring 66, as the connector is removed from the shaft. It is apparent that only a very small amount of axial travel of nut 66 on shaft 90, i.e., an amount produced by only one or two revolutions of the nut, is required to bring the end of the shaft into contact with surface 72*b* of post flange 72.

From the foregoing it will be seen that the connector of the invention addresses a long standing problem in the art, i.e., the frequent failure of the typical, non-technical user to effect proper installation of an F-type coaxial cable connector to a port (threaded shaft) on video equipment. The structure of the connector is such that positive ground contact between the connector and port and an effective RFI shield are provided with a minimal amount of threaded engagement of the connector and port. The first described embodiment of the connector accommodates a standard cable prep length, saving time in the manufacture of jumpers, as well as enhancing the product's marketability as an individual connector since it does not require the purchase of non-standard prep tools. The skirt of the nut surrounding essentially the entire connector structure also affords greater ease of use since it provides a larger surface for finger grip, and it extends close to the back of the connector, allowing easier access when the connector is recessed into the back of the equipment. It should also be pointed out that threaded bores 22 and 76 of the two embodiments are of the same diameter, both being intended for threaded connection to the same shaft at the equipment port, i.e., shaft 90 is the same as shaft 56. This means that flange 26 of post 14 is of larger diameter than flange 72 of post 62, and the outer surface of nut 12 is larger than that of nut 66, thereby making manual manipulation of nut 12 easier.

What is claimed is:

1. An F-type connector for mounting upon a terminal end of a coaxial cable having a bare central conductor extending a predetermined length from the planar end surface of an inner dielectric layer, said connector comprising:

a) a post member having a hollow, substantially cylindrical stem portion with a central axis and first end surrounded by a metal flange having a planar annular surface perpendicular to said central axis;

b) means for securely maintaining said post in assembled relation with said terminal end of said cable;

c) a nut including an internally threaded bore sized for threaded engagement with a hollow, threaded shaft at a port on video equipment to which said cable is to be electrically coupled, said shaft having a metal, terminal end;

d) means for mounting said nut in encircling relation to at least a portion of said post including said flange for free rotation and limited axial movement between first and second positions relative to said post; and e) a spring biasing said nut toward said first position wherein said nut may be placed in alignment with said shaft and rotated not more than three revolutions to bring said terminal end of said shaft into contact, and thus RFI shielding relation, with said annular surface of said post, continued rotation of said nut moving said nut axially with respect to said post toward said second position against the biasing force of said spring.

2. The connector of claim 1 wherein said means for maintaining said post in assembled relation with said terminal end of said cable comprise compression engagement means.

3. The connector of claim 2 wherein said compression engagement means include an elastomeric body and a compression ring axially movable with respect to said body to radially compress the latter into tightly gripping relation with said cable.

4. The connector of claim 1 wherein said spring is a coil spring having opposite ends captured between portions of said post and said nut.

5. The connector of claim 4 wherein said portion of said post is a surface of said flange on the side thereof opposite said annular surface.

6. The connector of claim 5 wherein said threaded bore has a diameter substantially equal to that of said flange.

7. The connector of claim 6 wherein said nut includes an internal flange and wherein said portion of said nut comprises said internal flange.

8. The connector of claim 5 wherein said threaded bore has a diameter less than that of said flange and wherein said nut includes a hollow skirt portion having an inside diameter slightly larger than said flange and a terminal, open end.

9. The connector of claim 8 wherein said skirt is deformed inwardly about its entire periphery to a diameter less than said inside diameter at said open end, and said portion of said nut comprises said periphery of said open end.

10. The connector of claim 9 and further including an elastomeric body encircling said stem portion of said post and a compression ring.

11. The connector of claim 10 wherein said spring encircles at least portions of said body and said ring, being positioned in an annular space between said inside diameter of said skirt and outside surfaces of said body and compression ring.

12. An F-type connector for permanent mounting upon a terminal end of a conventional coaxial cable having a central conductor, an inner dielectric layer, a conductive layer, a shielding layer and an outer dielectric layer, said cable being prepared for mounting of said connector by stripping away all of said layers from a first, predetermined length of said central conductor and stripping away said shielding and outer dielectric layers from a second, predetermined length of said conductive layer in order to electrically connect said central conductor to contacts at a video equipment port surrounded by a threaded, metal shaft having an annular terminal end, said connector comprising:

a) a metal post having a hollow, substantially cylindrical stem and a flange extending radially outwardly from one end of said stem, said flange having first and second, opposite, annular surfaces;

b) a body portion of elastomeric material having an outer surface and a through bore with:

i) a first portion having a diameter substantially equal to the outside diameter of said stem, said stem extending through and contacting said first portion of said bore over a first axial portion of said stem adjoining said second surface of said flange, and ii) a second portion having a cross section larger than said outside diameter of said stem, said second portion of said bore surrounding said stem in outwardly spaced relation thereto over a second axial portion thereof to form a first annular cavity between said second axial portion of said stem and said second portion of said bore;

c) a compression ring surrounding a portion of said body outer surface, said ring being axially movable upon said body to radially compress the latter into firm engagement with portions of said cable positioned within said annular cavity;

d) a nut having a threaded bore at one end and a cylindrical skirt extending integrally from said one end to an open end, said skirt having an inside diameter substantially equal to the diameter of said flange, said skirt surrounding said flange and portions of said body and ring inwardly spaced from said skirt to form a second annular cavity between said skirt and said inwardly spaced portions, said nut including an annular lip surrounding said open end and extending inwardly to a diameter less than said inside diameter of said skirt; and e) a coil spring disposed within said second annular cavity and having a first end contacting said second surface of said flange and a second end contacting said annular lip, said nut being axially movable with respect to said post, body and ring between a first position, toward which said nut is biased by said spring and wherein a first abutment portion of said nut engages a second abutment portion of said post, and a second position, wherein said spring is compressed to a length less than in said first position of said nut.

13. The connector of claim 12 wherein said first abutment surface is an internal surface of said nut surrounding said threaded bore.

14. The connector of claim 13 wherein said second abutment surface is said first surface of said flange.

15. The connector of claim 12 wherein said first and second ends of said spring lie in parallel planes.

16. The connector of claim 12 wherein said first and second surfaces of said flange lie in parallel planes.

17. The connector of claim 12 wherein said first and second predetermined lengths correspond to industry-standard lengths for preparation of coaxial cable to be mounted to industry-standard F-type connectors.

18. The method of fabricating and assembling an F-type connector for mounting upon an end portion of a coaxial cable, said method comprising:

a) providing a post having a substantially cylindrical, hollow, post with first and second ends and an annular flange extending radially outwardly from said first end of said post to a first diameter, said flange having a first surface adjoining said second end of said post and a second surface, parallel to and facing oppositely from said first surface;

b) providing a coil spring having opposite ends in parallel planes, and predetermined inner and outer diameters and undeformed axial length;

c) providing a nut having an end portion with inner and outer surfaces surrounding a threaded bore and a skirt extending integrally from said end portion for a predetermined axial distance to an open end, said skirt having a substantially cylindrical inner surface with a diameter not less than and substantially equal to said first diameter;

d) providing a body portion having a through bore with a first portion of diameter substantially equal to the outer diameter of said post, and a second portion of diameter larger than that of said first portion, said body portion further having an outer surface of predetermined configuration;

e) providing, a substantially cylindrical, hollow compression ring having an interior surface configured to surround and compress said body portion radially inwardly in response to relative axial movement of said body portion and ring;

f) inserting said post through said first portion of said body portion bore until said body portion abuts said first surface of said flange;

g) placing said ring in frictional engagement with said body portion outer surface;

h) passing said ring and body portion through said spring to place one of said opposite ends of said spring in contact with said first surface of said flange;

i) passing said skirt over said flange to place said inner surface of said nut end portion in contact with said second surface of said flange and forming an annular cavity between said inner surface of said skirt and portions of said ring and body portion outer surface, said spring being disposed entirely within said cavity, said undeformed axial length of said spring being so related to said axial distance of extent of said skirt that said open end of said skirt extends post said other of said opposite ends of said spring; and j) bending said open end of said skirt radially inwardly to form an annular lip of diameter less than said outer diameter of said spring, whereby said spring is axially captured between said first surface of said flange and said annular lip of said skirt, permitting axial compression of said spring by relative axial movement of said nut and said post, body portion and ring.

19. The method of claim 18 wherein said annular lip lies in closely encircling relation to said compression ring.

20. The method of claim 18 and further including mounting said connector upon a prepared terminal end of a coaxial cable and moving said ring axially upon said body portion outer surface to radially compress said body portion into tight frictional engagement with said cable.

21. The method of fabricating and assembling an F-type connector for mounting upon a prepared terminal end of a coaxial cable, said method comprising:

a) forming a post having a hollow stem portion extending linearly between first and second ends, and a first flange extending radially outwardly from said first end of said stem to a first diameter;

b) forming an elastomeric body member with a through bore and an external surface of predetermined configuration;

c) forming a compression ring cooperatively formed with said body member to compress said body member radially inwardly in response to relative axial movement of said body member and ring;

d) forming a nut having a through bore with third and fourth, open ends, a stop member extending radially inwardly of said bore to define a passageway of cross-dimension greater than the maximum outer cross-dimension of said stem and less than said first diameter, and an internally threaded portion having a second diameter at least as great as said first diameter between said stop member and said third end;

e) forming a coil spring having an inner diameter at least as large as said maximum outer cross-dimension of said stem, an outer diameter not greater than said first diameter, and a predetermined, undistorted axial length;

f) placing said spring into said third end of said nut to rest upon said stop member;

g) passing said second end of said stem through said third end of said nut and through said spring and stp member to extend from said fourth end of said nut and said first flange positioned within said internally threaded portion and said spring captured between said stop member and said first flange;

h) passing said stem at least partially through said body member bore to bring an abutment portion of said body external surface into contact with said fourth end of said nut, whereby said body portion limits axial movement of said nut in a first direction past a predetermined position relative to said stem and body member; and i) moving said compression ring axially into radially compressive engagement with a portion of said body member external surface, thereby fixing the relative positions of said stem, body portion and ring, and permitting axial movement of said nut away from said predetermined position in a second direction, opposite to said first direction, as said spring is compressed between said stop portion and said first flange.

22. The method of claim 21 and including the further step of mounting said connector to a prepared terminal end of a coaxial cable prior to axially moving said compression ring.

23. The method of claim 22 wherein said stop portion comprises a second flange defining a circular opening having a diameter less than the largest cross-dimension of said stem and less than said first diameter.

24. The method of claim 22 wherein said second diameter is substantially equal to said first diameter.

25. The method of claim 22 including the further step of engaging the threads of said internally threaded portion with the external threads of a metal shaft at a port of video equipment to which said coaxial cable is electrically connected.

26. The method of claim 25 wherein said predetermined position of said nut is such that not more than three revolutions of said nut are required to bring said shaft into contact with said first flange, thereby establishing RFI shielding of said coaxial cable.

27. An F-type connector for mounting upon a prepared terminal end of a coaxial cable to permit electrical connection of said cable to a port on video equipment by threaded engagement of said connector and a metal shaft surrounding said port, said connector comprising:

a) a plurality of cable engagement members secured to said terminal end, one of said engagement members having a planar surface in perpendicular, surrounding relation to said terminal end;

b) a nut having internal threads matable with external threads on said shaft, said nut being mounted to said engagement members for free rotation and limited axial movement from a rest position in a first direction with respect to said engagement members; and c) spring means biasing said nut toward said rest position.

28. The connector of claim 27 wherein said spring means comprise a coil spring compressible between portions of said nut and said one of said engagement members.

29. The connector of claim 28 wherein the relative position of said nut and said planar surface, when said nut is in said rest position, is such that the end of said shaft is brought into contact with said planar surface by not more than three revolutions of said nut into threaded engagement with said shaft, further revolutions of said nut after contact of said shaft with said planar surface resulting in relative axial movement of said nut and said engagement members away from said rest position of said nut.

30. The connector of claim 29 wherein said engagement members comprise a post, an elastomeric body member and a compression ring.

31. The connector of claim 30 wherein said planar surface has an outer, circular periphery of first diameter and a inner, circular periphery defining an opening of second diameter.

32. The connector of claim 31 wherein the diameter of said internal threads is less than said first diameter and greater than said second diameter.

33. The connector of claim 31 wherein the diameter of said internal threads is substantially equal to said first diameter.

* * * * *

US006716062C1

(12) INTER PARTES REEXAMINATION CERTIFICATE (788th)

United States Patent
Palinkas et al.

(10) Number: US 6,716,062 C1
(45) Certificate Issued: Jan. 9, 2014

(54) COAXIAL CABLE F CONNECTOR WITH IMPROVED RFI SEALING

(75) Inventors: Raymond Palinkas, Canastota, NY (US); Michael T. Fox, Syracuse, NY (US); Noah Montena, Syracuse, NY (US)

(73) Assignee: John Mezzalingua Associates, Inc., East Syracuse, NY (US)

Reexamination Request:
No. 95/001,492, Nov. 23, 2010

Reexamination Certificate for:

| | |
|---|---|
| Patent No.: | **6,716,062** |
| Issued: | **Apr. 6, 2004** |
| Appl. No.: | **10/277,756** |
| Filed: | **Oct. 21, 2002** |

(51) Int. Cl.
*H01R 9/05* (2006.01)
*H01R 13/622* (2006.01)

(52) U.S. Cl.
USPC ..... 439/578; 439/320; 439/700

(58) Field of Classification Search
None
See application file for complete search history.

(56) References Cited

To view the complete listing of prior art documents cited during the proceeding for Reexamination Control Number 95/001,492, please refer to the USPTO's public Patent Application Information Retrieval (PAIR) system under the Display References tab.

*Primary Examiner* — Mark Sager

(57) ABSTRACT

An F-type connector for mounting to a prepared terminal end of a coaxial cable for threaded engagement of a nut on the connector to a threaded shaft at a port on video equipment to which the coaxial cable is to be electrically connected. In the connector of the present invention, the nut is mounted for limited axial movement with respect to the post, body and compression ring. A coil spring biases the nut toward a rest position with respect to the other elements wherein not more than three revolutions of the nut into engagement with the shaft are necessary in order to bring the post of the connector into contact with the shaft on the equipment, providing a satisfactory coupling. Upon further revolution of the nut, the post and shaft remain in contact as the nut moves axially away from the rest position with respect to the other elements.

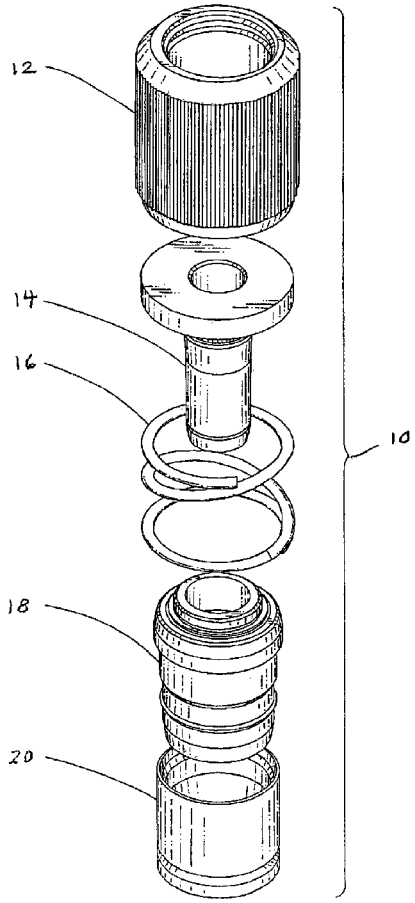

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 27-28 are cancelled.

Claims 1-26 and 29-33 were not reexamined.

* * * * *